US007137850B2

(12) United States Patent
Ewing et al.

(10) Patent No.: US 7,137,850 B2
(45) Date of Patent: Nov. 21, 2006

(54) CIRCUIT LINK CONNECTOR

(76) Inventors: Carrel W. Ewing, 5845 Lausanne Dr., Reno, NV (US) 89511; Andrew J. Cleveland, 5419 Greenview Ct., Reno, NV (US) 89502; James P. Maskaly, 1568 Topeka Cir., Sparks, NV (US) 89343; Dennis W. McGlumphy, 764 Snow Drop Ct., Sun Valley, NV (US) 89433; Nathan Moll, 5848 N. White Sands, Reno, NV (US) 89511

( * ) Notice: Subject to any disclaimer, the term of this patent is extended or adjusted under 35 U.S.C. 154(b) by 0 days.

(21) Appl. No.: 11/059,266

(22) Filed: Feb. 15, 2005

(65) Prior Publication Data

US 2006/0094299 A1 May 4, 2006

Related U.S. Application Data

(60) Provisional application No. 60/624,286, filed on Nov. 1, 2004.

(51) Int. Cl.
*H01R 24/00* (2006.01)

(52) U.S. Cl. ..... 439/652; 439/535

(58) Field of Classification Search ..... 439/652, 439/49, 718, 716, 620, 719, 668–669, 188–189, 439/61, 354, 488–490, 76.2, 709, 107, 650, 439/535, 536, 373; 307/101, 150; 174/59, 174/66–67; 361/415, 621–626, 118, 652, 361/641–643, 648, 833, 836

See application file for complete search history.

(56) References Cited

U.S. PATENT DOCUMENTS 4,840,568 A * 6/1989 Burroughs et al. ..... 439/49
5,680,294 A * 10/1997 Stora et al. ..... 361/695
5,821,636 A 10/1998 Baker et al.
6,220,880 B1 * 4/2001 Lee et al. ..... 439/214
6,380,862 B1 * 4/2002 Karim et al. ..... 340/635
6,443,746 B1 * 9/2002 Yu ..... 439/107
6,626,705 B1 * 9/2003 Perrone et al. ..... 439/668
6,667,681 B1 12/2003 Meiners et al.
6,826,036 B1 11/2004 Pereira
6,827,582 B1 * 12/2004 Morris et al. ..... 439/49
6,882,530 B1 4/2005 Cyphers et al.
6,897,379 B1 * 5/2005 Hsiao ..... 174/53
6,940,730 B1 * 9/2005 Berg et al. ..... 361/796
6,967,283 B1 11/2005 Rasmussen et al.
2005/0094357 A1 * 5/2005 Ewing et al. ..... 361/626
2005/0259383 A1 11/2005 Ewing et al.

* cited by examiner

*Primary Examiner*—Truc T. Nguyen
*Assistant Examiner*—Edwin A. Leon
(74) *Attorney, Agent, or Firm*—Klarquist Sparkman, LLP

(57) ABSTRACT

Certain embodiments provide a power distribution unit that may be used to distribute power to a plurality of electronic devices. The power distribution unit may have one or more outlet gangs, integral components having a plurality of individual power outlets. Each outlet gang may be associated with one or more power rails which deliver power to each power outlet. A connector may be located on each power rail. The power distribution unit may include a circuit link interconnection board for connection to one or more electronic components, such as outlet gangs. A circuit link is coupled to the circuit link interconnection board and fuseably protects at least one circuit of the interconnection board. Access windows may be provided to provide access to the circuit link.

26 Claims, 7 Drawing Sheets

CIRCUIT LINK CONNECTOR

CROSS REFERENCE TO RELATED APPLICATION

The present application claims the benefit of, and hereby expressly incorporates by reference in its entirety, U.S. Provisional Patent Application No. 60/624,286, filed Nov. 1, 2004, and entitled "POWER DISTRIBUTION APPARATUS," by Ewing et al.

TECHNICAL FIELD

The present invention relates to circuit link connectors. Certain embodiments provide power distribution apparatus utilizing such circuit link connectors.

BACKGROUND

Electronic equipment racks commonly consist of rectangular or box-shaped housings or rack structures. Electronic equipment is commonly mountable in such racks so that the various electronic components are aligned vertically one on top of the other in the rack. Often, multiple racks are oriented side-by-side, with each rack containing numerous electronic components and having substantial quantities of associated component wiring located both within and outside of the area occupied by the racks.

Power distribution units have long been utilized to supply power to the equipment in such racks. Power distribution units have also been designed to allow a user to remotely monitor and control the power distribution unit or devices attached to the power distribution unit. Examples of such power distribution units can be found in U.S. Pat. Nos. 5,506,573, 5,949,947, and 6,711,613.

One particularly common such power distribution unit consists of an elongated box housing that has one or more power inputs penetrating the housing and a number of power outputs extending along the longitudinal face of the unit. This power distribution unit is designed to mount vertically adjacent or secured to the external rear side of a rack. In this fashion, the power supplied to the unit is then distributed through horizontally extending power outputs to the, typically, horizontally co-aligned electronic components mounted in the rack. An example of such a prior power distribution unit is sold under the trademark POWER TOWER by Server Technology, Inc., of Reno, Nev.

As previously stated, each power distribution unit typically contains a number of power outputs and at least one power input. The power distribution units may also contain other electronic components, such as fuses and monitoring devices. Typically, all of these electronic components must be wired together, which can create numerous problems and inefficiencies.

One such problem is that the size of the electronic components and the associated wiring may limit the dimensions and shape of the housing. A housing having a certain minimum size usually is required merely to hold the electronic components and wiring of the power distribution unit. The size of the housing can limit the locations in which the power distribution unit can be mounted. For example, the power distribution unit may be too large for certain spaces. The size of the components and wiring may limit how many and what kind of components can be included in a power distribution unit. The housing typically must be sized such that the various electronic components do not make undesired contact with each other.

Another problem with such prior art power distribution units is that they often require substantial time and effort to assemble because each electronic component is typically individually mounted in the housing. Furthermore, each electronic component is typically individually wired with line, neutral, and ground connections. The cost to build such power distribution units may be influenced by material costs that are partially determined by factors such as the size of the housing, the amount of wiring in each power distribution unit, and the amount of other materials, such as solder, needed to assemble each power distribution unit. In addition to possibly requiring greater assembly time, the numerous parts and connections in typical prior art power distribution units may result in a greater number of errors during the manufacturing process or a greater chance of equipment failure once the power distribution units are in use.

Another problem with some prior art power distribution units stems from the fuses or other devices that are typically used to protect the power distribution unit and attached electronic devices against current fluctuations. Often, the fuses may only be checked and replaced by removing the power distribution unit from a rack and opening the power distribution unit. In addition to possibly being time consuming and labor intensive, opening up the unit may violate a warranty on the unit.

Many standards setting organizations, certifying bodies, and codes are requiring branched circuit protection. That is, power outlets may be arranged in groups or "branches," each of which must be separately fused. Branched circuit protection may result in an increased number of fuses in each power distribution unit, thus potentially increasing the size of, and the amount of wiring in, the power distribution unit.

BRIEF SUMMARY OF ASPECTS OF THE INVENTION

The present disclosure related to a circuit link interconnection board. Certain embodiments provide a power distribution unit constructed using at least one circuit link interconnection board.

In a first embodiment, the circuit link interconnection board includes at least one circuit link. A plurality of contacts are located on the circuit link interconnection board. A first portion of the plurality of contacts may place the circuit link interconnection board in communication with at least a first electrical component.

In a second embodiment, a second portion of the plurality of contacts may place the circuit link interconnection board in communication with at least a second electronic component. In the case of an electrical abnormality, such as a current spike, the circuit link interconnection board will open a circuit, interrupting communication with the first or second electronic components.

In a third embodiment, the circuit link interconnection board is connected to a power source. Power from the power source, such as AC line power, may be transmitted to the first or second electrical components through the circuit link interconnection board. In additional embodiments, the circuit link interconnection board may carry electrical signals which may represent data.

In a fourth embodiment, the first electronic component is a ganged power outlet. In a fifth embodiment, the first and second electronic components are ganged power outlets. Ganged power outlets are single electronic components that contain a plurality of individual power outlets. The outlet gang includes at least one power rail coupled to the individual power outlets. The power rail may be connected to each individual power outlet in the outlet gang in order to deliver power, such as AC line power, to each individual power outlet. The power rail may have a connector at least at one end. In certain embodiments, the power rail has connectors at two ends.

Certain embodiments of the present invention may provide power distribution units having reduced amounts of wiring. Wiring reduction can occur in a number of ways. First, in certain embodiments, electronic components are connected to power supplies or circuit links (such as fuses or circuit breakers) through the circuit link interconnection board. The use of the circuit link interconnection board can obviate the need for discreetly wiring each electronic component.

Similarly, in further embodiments, the electronic components are directly connected to the interconnection board. Direct connection of the electronic components to the interconnection board may eliminate the need to use discrete wires to connect the electronic components to the circuit link interconnection board.

Power distribution units having reduced wiring may provide a number of advantages. For example, the size of a power distribution unit may be reduced because each outlet no longer need necessarily be connected by standard wires. Because of the reduced number of parts, these embodiments may provide other benefits, such as faster assembly, fewer assembly errors, enhanced reliability, and easier repair and service.

In addition, the potential compactness of certain embodiments may allow additional electronic components to be added to the power distribution unit without significantly increasing the size of the housing. Also, the modular nature of circuit link interconnection boards and outlet gangs may allow easier repair or replacement of components of the power distribution unit.

In a sixth embodiment, the circuit link interconnection board comprises a fuse holder. In a seventh embodiment, the circuit link interconnection board includes a plurality of fuse holders. A fuse may be coupled to the fuse holders of the sixth and seventh embodiments.

In an eighth embodiment, the circuit link interconnection board includes a plurality of circuit links and is in power supply communication with a plurality of electrical devices. The electrical devices are connected to the interconnection board in a plurality of branches, each of the branches being protected by at least one circuit link.

In a ninth embodiment, an indicator is provided to display the status of a circuit link. In at least one embodiment, the indicator is coupled to the circuit link interconnection board. For example, an LED may be connected a particular circuit protected by a circuit link and normally lit when the circuit is closed. If the circuit link is tripped, such as when a fuse is blown, the LED will be turned off, indicating that the circuit is open.

In a tenth embodiment, the circuit link interconnection board is a printed circuit board having a plurality of layers. One or more layers of the printed circuit board may transmit a particular electrical component. For example, in AC line power transmission, one layer may correspond to an AC line connection and another layer may correspond to an AC neutral connection. Other layers could be used for a ground connection or to transmit other electrical signals, including communication signals.

Using an entire layer of a circuit board to transmit an electrical component may allow a larger amount of the electrical component, such as a component of AC line power, to be transmitted using the circuit board. The relatively large transmission capacity of the layers of the circuit board may allow the circuit board to function as an assembly of wires.

In an eleventh embodiment, the circuit link interconnection board is similar to the circuit link interconnection board of the tenth embodiment but includes at least one layer formed in a plurality of sublayers. An insulating barrier may separate each sublayer. Accordingly, each sublayer may be used to transmit a different electrical component, such as a component of AC line power or data. The use of a power connection board having a layer formed in a plurality of sublayers may allow the power connection board to have fewer layers, to transmit more electrical components, and/or be attached to a greater number of electrical parts. The size of the sublayer is preferably sufficiently large to allow effective transmission of the particular electric component.

In a twelfth embodiment, the interconnection board may allow connections to electronic components to be made in varying configurations. For example, certain embodiments of the invention may provide two electrical parts in a back to back configuration, with the interconnection board intermediate the electrical parts. If standard wires were used, the wires would need to cross in order to properly connect the electrical parts. The crossed wires may make the assembly of the power distribution unit more complex and may require more space in the housing. Using the interconnection board, this configuration (the crossing of the connection) can be made internal, requiring no modification of the housing or in how the power distribution units are assembled.

In a thirteenth embodiment, the circuit link interconnection board is disposed in a power distribution unit having circuit link access openings. The circuit link access openings may allow access to, or visual inspection of, circuit links of the circuit link interconnection board. In certain embodiments, an operator may reset the circuit link, such as by replacing a fuse or resetting a circuit breaker, without having to remove or disassemble the power distribution unit. The access openings may be covered, including by transparent windows or by protective coverings such as metal or plastic plates.

In a fourteenth embodiment, the circuit link interconnection board includes a ground connection for a circuit of the circuit link interconnection board. A fastener opening may be formed in the circuit link interconnection board and in communication with the circuit. A fastener may be inserted through the fastener opening and coupled to a ground, such as the housing of a power distribution unit. The use of the fastener as a ground connection may reduce the wiring requirements of power distribution units according to this embodiment because this embodiment may obviate wiring a separate ground connection.

It is to be understood that this Summary of the Invention lists various aspects of various embodiments of the present invention. Additional aspects of the present invention will become apparent as this specification proceeds.

It is also to be understood that all features noted above need not be included in a given embodiment and that not all deficiencies noted in the prior art need be overcome by a given embodiment in order for it to fall within the scope of the present invention.

BRIEF DESCRIPTION OF THE DRAWINGS

The preferred embodiments are shown in the accompanying drawings in which.

DETAILED DESCRIPTION OF THE PREFERRED EMBODIMENTS

Figure 1:
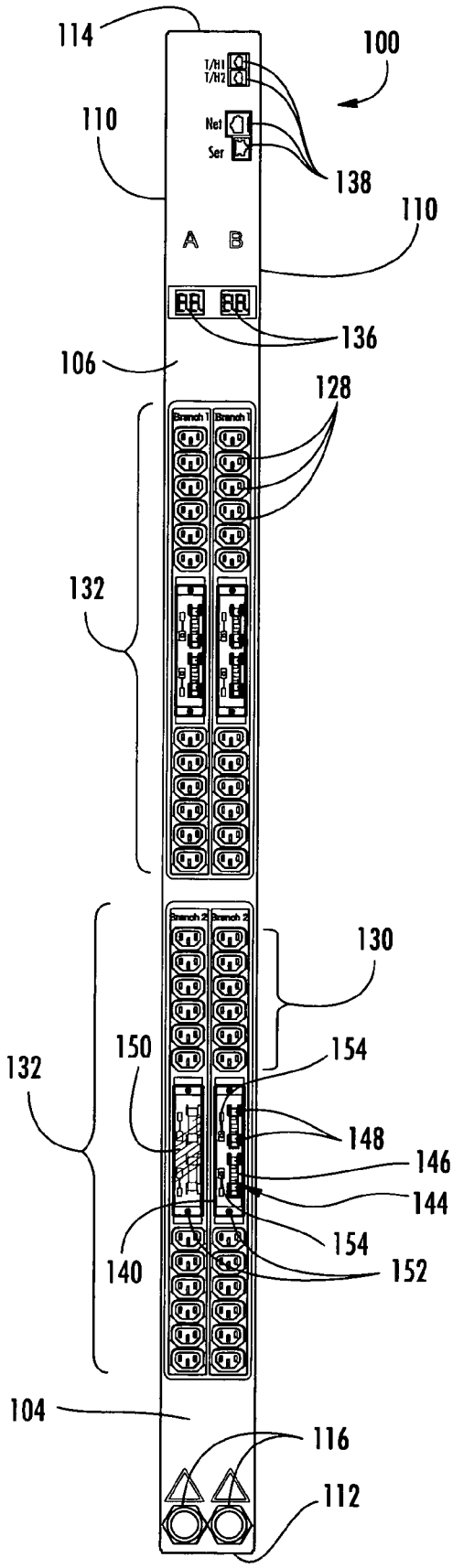
FIG. 1 is a front elevational view of a power distribution apparatus of an embodiment of the present invention having a circuit link interconnection board.

A power distribution apparatus (PDA) 100 according to an embodiment of the present invention is shown in FIG. 1. The PDA 100 may be mounted to a rack (not shown). The PDA 100 has a housing 104. The housing 104 may be of any suitable dimensions. The housing 104 is preferably sized for mounting to a rack. The housing 104 is shown as a rectangular box having longitudinally extending front 106 and back 108 (FIG. 3) faces, two longitudinally extending lateral sides 110, a first end 112, and a second end 114. Of course, shapes other than rectangular boxes could be used.

The housing 104 is made of a substantially rigid and durable material, such as metals or plastics, including polycarbonate resins. In at least one embodiment, the housing 104 is made of sheet metal.

Two power inputs 116 are coupled to the housing 104. Although two power inputs 116 are shown, more or less power inputs 116 could be used. In the illustrated embodiment, the power inputs 116 are connected through the front face 106 of the housing 104, proximate the first end 112 of the housing 104. The power inputs 116 may be connected to a power supply (not shown), such as an AC line power supply, to provide a desired level of power to one or more electrical appliances (not shown). The power inputs 116 may be adapted to employ single phase power or polyphase power, such as double or triple-phase power. In embodiments employing multiphase power, multiphase power may be provided to attached electrical devices. In other embodiments, the phases are resolved and a single phase is delivered to attached electrical devices.

The housing 104 may have one or more outlet apertures 124 (FIGS. 4 and 5) through which a plurality of power outlets 128 extend. The apertures 124 are rectangular openings in the front face 106 of the housing 104. One or more power outlets 128 may represent a discrete power unit, or "branch" 132. Each branch 132 may be independently supplied with power, provided with circuit protection (such as a fuse), monitored, controlled, or wired.

In certain embodiments, including the embodiment of FIG. 1, the power outlets 128 are part of a ganged power outlet 130. A ganged power outlet 130 is a module having a plurality of electrical outlets 128. The ganged power outlets 130 may be integral components. The ganged outlets 130 are type 0909 ganged outlets available from Shurter, Inc., of Santa Rosa, Calif. Other types of ganged outlets may be used, including those disclosed in U.S. Provisional Patent Application No. 60/653,577, filed Feb. 15, 2005 and entitled "GANGED OUTLET APPARATUS," by Andrew J. Cleveland, which is hereby expressly incorporated by reference in its entirety.

The ganged outlets 130 are shown as generally linear arrangements of outlets 128, which may be arranged in columns or rows. Each branch 132 may include one or more ganged outlets 130 and/or outlets 128. As shown, two ganged outlets 130 are placed side-by-side, providing two columns of outlets 128 longitudinally extending down the front face 106 of the PDA 100.

The ganged outlets 130 may be configured to deliver the same or different amounts and types of power to their corresponding power outlets 128 and their associated electronic components. For example, one ganged outlet 130 may provide 120V, 20 A power while another ganged outlet 130 may provide 240V, 50 A power. Other ganged outlets 130 may operate at 208V. In addition, the ganged outlets 130 may have varying numbers of power outlets 128. The ganged outlets 130 may be used exclusively in the PDA 100 or in conjunction with individual outlets 128 (which may be configured to operate at any suitable voltage/current).

With continued reference to FIG. 1, a plurality of displays 136 are provided on the housing 104. As shown in FIG. 1, two displays 136 are viewable on the front face 106, proximate the second end 114, of the housing 104. The displays 136 are shown as LED displays, but may be of any suitable type, such as LCD displays.

The displays 136 provide users with information on the status of the PDA 100. Such information may include the total current drawn by one or more of the outlet gangs 130, the outlets 128, branches 132, or combinations thereof. In the embodiment of FIG. 1, each display 136 may indicate the current drawn by one of the two branches 132 or the power supplied by an input 116. In certain embodiments, one or more displays 136 indicate whether a circuit is closed or open, such as when a fuse has blown. In additional embodiments, the displays 136 display other information, such as the ambient temperature or humidity.

The PDA 100 is provided with communication connections 138. The communication connections 138 are used to send information from, or provide information to, the PDA 100. For example, the communication connections 138 may be used to provide information over a network, such as the Internet, regarding the PDA 100 to a remote user. In other embodiments, the communication connection 138 may be used by service technicians to troubleshoot, program, or obtain data from the PDA 100. In additional embodiments, sensors, such as temperature and/or humidity sensors, may be attached to the communication connections 138. The communication connections 138 may be configured to accept any desired type of communication means, such as USB connections, Ethernet connections, parallel port connections, serial connections, RS232 connections, etc.

A plurality of access openings 140 are formed in the front face 106 of the housing 104. The rectangular access openings 140 are shown longitudinally disposed at regular intervals on the front face 106 of the housing 104. The access openings 140 allow convenient access to certain components of the PDA 100.

For example, a fuse assembly 144 is accessible through each access opening 140. A fuse 146 may be removed from, or installed into, the fuse assembly 144. Each fuse assembly 144 includes two pairs of clamp arms 148, each pair of clamp arms 148 securing the removable fuse 146 and placing the fuse 146 in electrical communication with a circuit of the PDA 100. Other interrupting devices (circuit links), such as circuit breakers, for example, may be utilized rather than the fuses 146.

The access openings 140 are covered by removable protective coverings, such as plastic or glass windows 150 which are secured to the housing 104 by fasteners 152. In at least one embodiment, the windows 150 are made from Lucite. The fasteners 152 are shown as screws, but other fasteners may be used, including bolts and pins. The fuses 146 may thereby be observed and replaced as desired without removing the PDA 100 from the rack and without significantly disassembling the PDA 100.

A fuse state indicator 154 is provided to indicate the status of a fuse 146. The fuse state indicator 154 may be part of the fuse 146 or separate. For example, a fuse 146 may be provided that changes appearance when it has blown. In other embodiments, such as that illustrated in FIG. 1, a separate fuse state indicator 154 is provided which is visible to a user. The separate fuse state indicator 154 may be an illumination device, such as an LED, in communication with the fuse 146, and which changes state if the fuse 146 blows. In one embodiment, the fuse state indicator 154 is an LED that is normally illuminated. When a fuse 146 blows, the LED 154 is turned off, providing a visual cue that the fuse 146 has blown.

Figure 2:
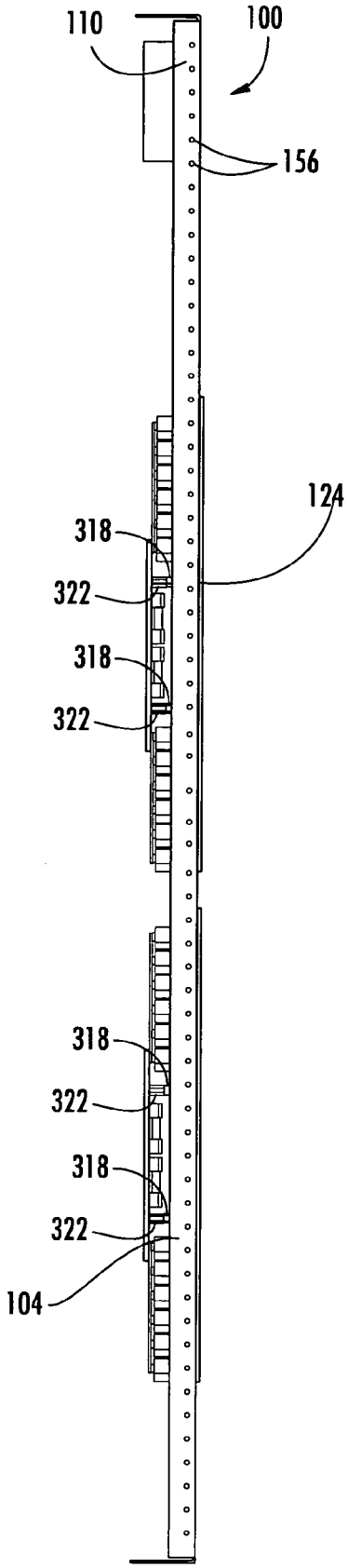
FIG. 2 is an elevational view of a lateral side of the power distribution apparatus of FIG. 1.

With reference now to FIG. 2, the PDA 100 has a plurality of strain relief mounts 156 spaced longitudinally along a longitudinal side 110 of the housing 104. Stain relief devices (not shown), such as wire bails, may be attached to the strain relief mounts 156. The strain relief devices are configured to abut power cords of devices attached to the outlets 128 of the PDA 100. The strain relief devices serve to organize such power cords, as well as secure them in position.

Figure 5:
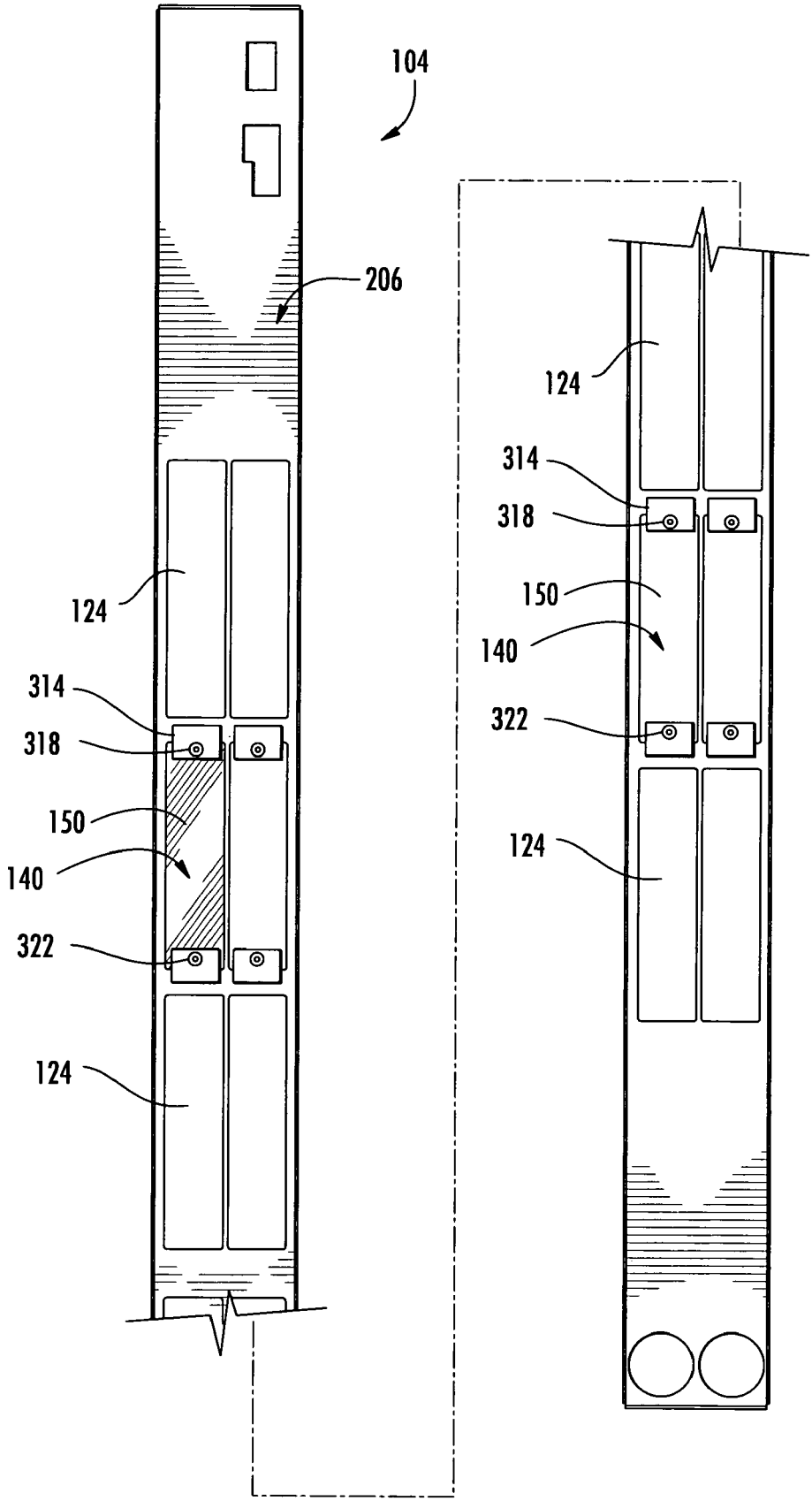
FIG. 5 is an elevational view of the inside of the top housing portion of a power distribution apparatus of the present invention.

Each fuse assembly 144 is mounted to the housing 104 by a fastener (not shown), such as a screw, a nail, a bolt, or a pin, which extends into a standoff mount 322 coupled to a cylindrical protrusion 318 on the housing 104 (also see FIG. 5).

Figure 3:
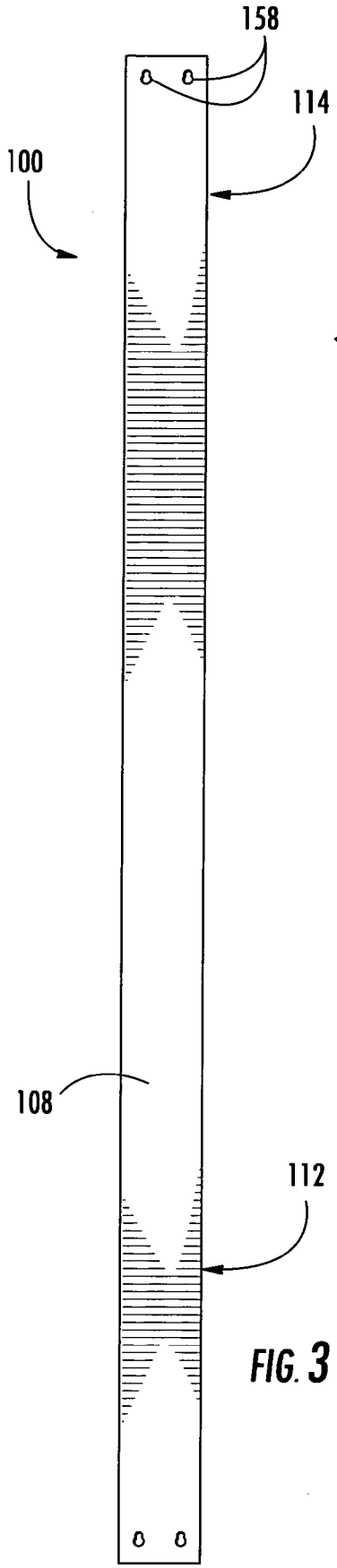
FIG. 3 is an elevational view of the back of the power distribution apparatus of FIG. 1.

As shown in FIG. 3, the housing 104 has a plurality of fastener openings 158 located at the ends 112, 114 of the housing 104. The fastener openings 158 may be used in conjunction with a fastener (not shown), such as a nail, a bolt, a screw, a pin, etc., to secure the PDA 100 to a rack. The fastener openings 158 may be threaded for receiving a bolt or screw (not shown) which is received by a corresponding opening in the rack. The number, spacing, and location of the fastener openings 158 may be varied as desired in order to enable the PDA 100 to be mounted to various types of racks. In addition, the fastener openings 158 may be provided to additional or alternate sides, faces, or ends of the housing 104 as needed.

Alternatively, the housing 104 may be provided with mounting brackets (not shown) at the first 112 and/or second 114 ends of the PDA 100. The mounting brackets may allow the PDA 100 to be mounted in a larger number of configurations. For example, racks are made by a variety of manufacturers and may differ in size and construction. The mounting adapters may allow the PDA 100 to be used with a variety of rack types. For example, racks made by American Power Conversion, Inc., of West Kingston, R.I., may be configured with mounting apertures that receive mounting pegs located on a device. Accordingly, in certain embodiments, the PDA 100 may be provided with mounting pegs (not shown), which may be received by mounting apertures (not shown) in a rack, to help secure the PDA 100 to the rack. Additional mounting adapters, which may be located at the top 114 and/or bottom 112 ends of the PDA 100, may further secure the PDA 100 to the rack.

Figure 4:
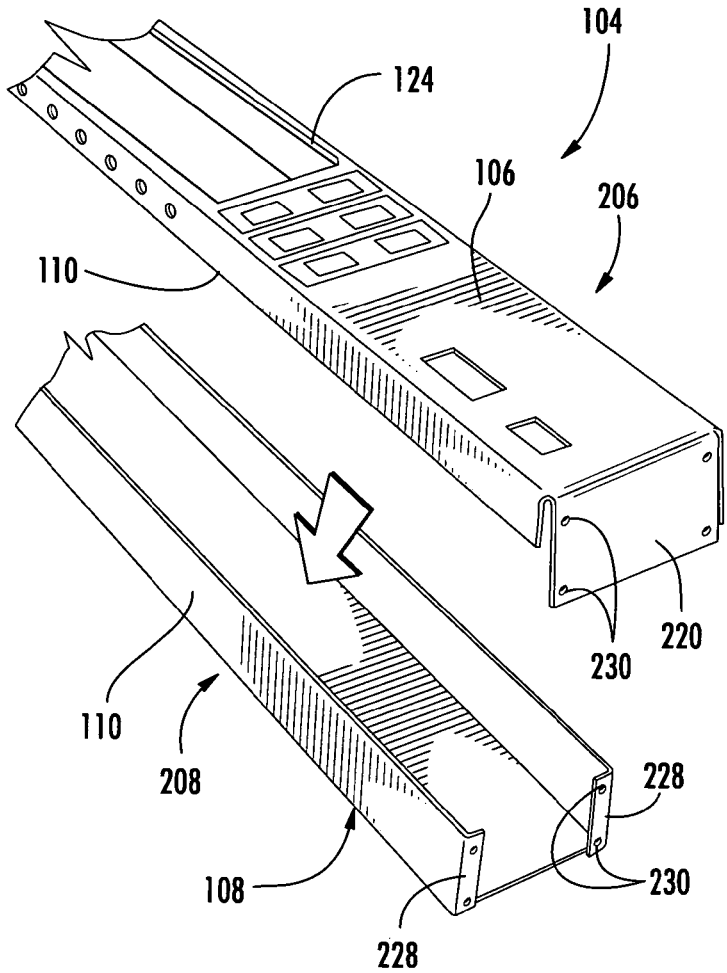
FIG. 4 is a perspective view of top and bottom sections of the housing of the power distribution apparatus of FIG. 1, illustrating how top and bottom portions of the housing may fit together.

Turning now to FIG. 4, an embodiment of a housing 104 for the PDA 100 is shown. In the embodiment of FIG. 4, the housing 104 is composed of two substantially U-shaped portions 206, 208. The upper U-shaped portion 206 forms the front face 106 and partially forms the lateral sides 110 of the housing 104. The lower U-shaped portion 208 forms the back face 108 and partially forms the lateral sides 110 of the housing 104.

The lower U-shaped portion 208 and the upper U-shaped portion 206 may be coupled by any suitable means. In the embodiment of FIG. 4, the lower U-shaped portion 208 slides over and matingly engages the upper U-shaped portion 206. The ends of the upper U-shaped portion 206 include a flap 220. The ends of the lower U-shaped portion 208 have flanges 228 that matingly engage the outer portion of the flaps 220. The upper U-shaped portion 206 and the lower U-shaped portion 208 are secured together by inserting fasteners (not shown) through fastener openings 230 in the ends of the upper U-shaped portion 206 and the ends of the lower U-shaped portion 208. The fastener openings 230 may be threaded for receiving matingly threaded fasteners.

Figure 6:
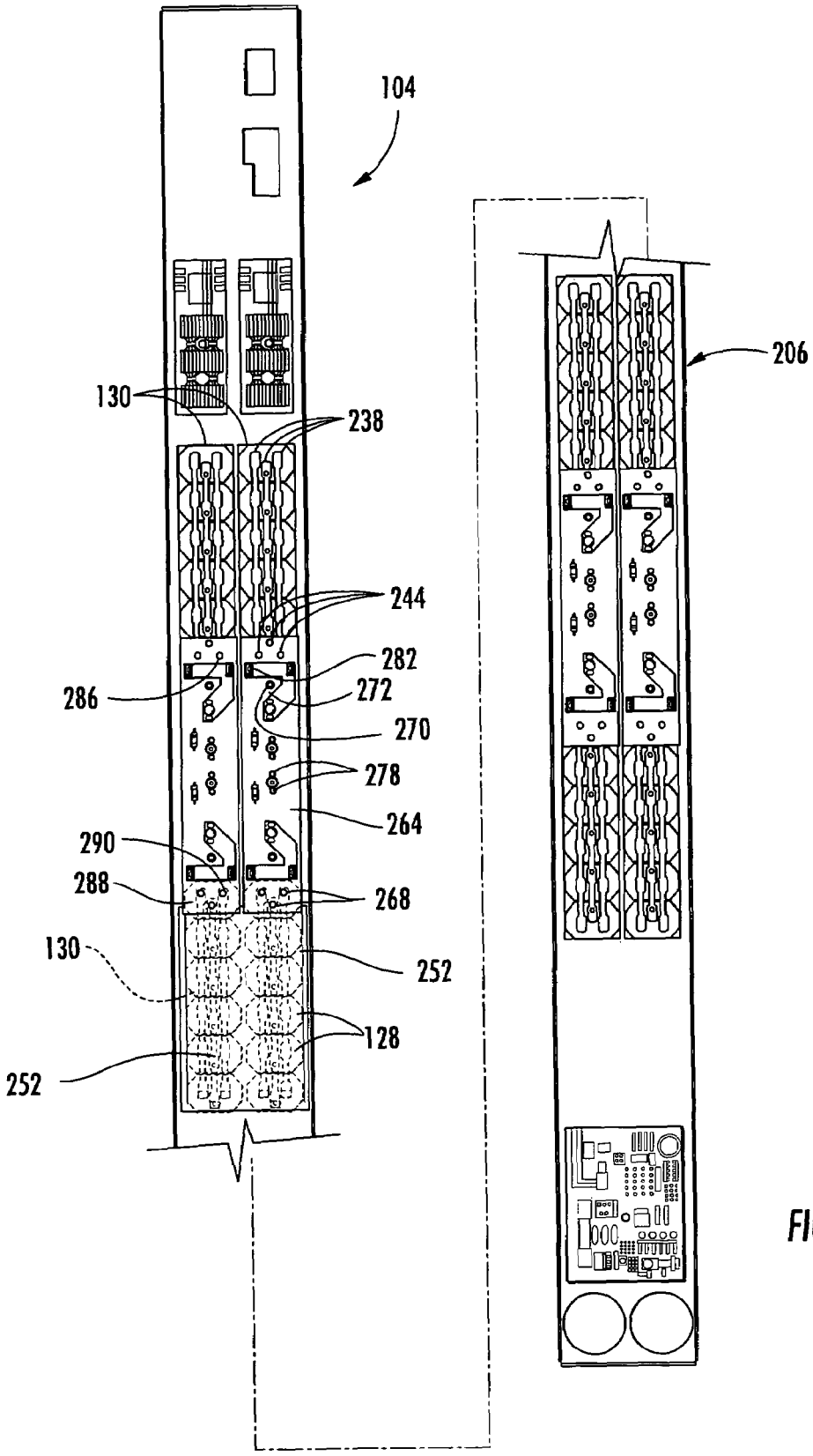
FIG. 6 is an elevational view of the inside of the top housing portion of the power distribution apparatus of FIG. 5 illustrating the placement of outlet gangs and other electronic components within the power distribution apparatus.
Figure 7:
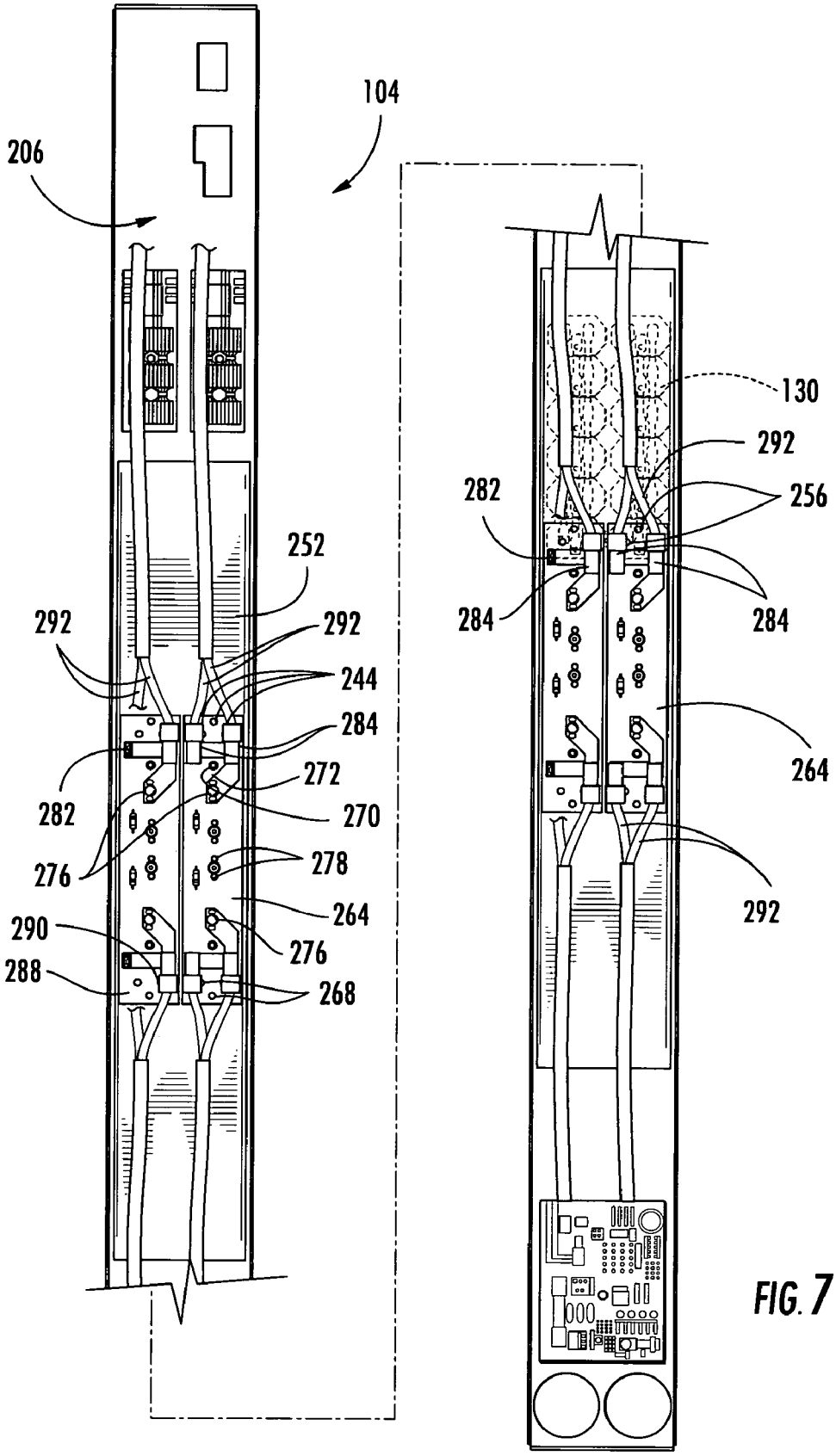
FIG. 7 is an elevational view of the inside of the top housing portion of the power distribution apparatus of FIG. 5 illustrating the placement of interconnection boards and nonconductive material on top of the components shown in FIG. 6.

FIGS. 5–7 show how the various components of the PDA 100 may be assembled within the housing 104. With reference first to FIG. 5, a view of the inside portion of the upper U-shaped portion 206 of the housing 104 is shown. A number of outlet apertures 124 can be seen extending longitudinally along the face 106 of the upper U-shaped portion 206.

An access opening 140 is disposed between each pair of outlet apertures 124. A window 150 is secured to each access opening 140 by fasteners 152 (FIG. 1). A rectangular mounting plate 314 is coupled to the top and bottom portion of each access opening 140. The mounting plate 314 has a cylindrical protrusion 318 (also see FIG. 2) extending into the interior of the housing 104. The cylindrical protrusion 318 is threaded for receiving the fasteners 152 from the outside of the housing 104 and for receiving a standoff mount 322 on the inside of the housing 104. The standoff mount 322 is matingly threaded for coupling to the cylindrical protrusion 318.

With reference now to FIG. 6, a plurality of linear outlet gangs 130 are shown mounted in the upper U-shaped portion 206, extending through the outlet apertures 124 (FIG. 5). Each outlet gang 130 provides a column of outlets 128. As shown, three generally linear power rails 238 are coupled to the back of each outlet gang 130. Depending on the application, more or less power rails 238 could be used. Each power rail 238 runs substantially the length of the back side of an outlet gang 130 and is connected to each outlet 128 in the outlet gang 130. The power rails 238 may be laterally spaced, being generally co-aligned. In certain embodiments, the power rails 238 are parallel.

An insulating barrier (not shown), which may be a protrusion, such as a flange or ridge extending from the back of an outlet gang 130, may be used to prevent electrical contact between adjacent power rails 238. In certain embodiments, the power rails 238 may be located internally within the outlet gang 130. Locating the power rails 238 within the outlet gangs 130 may reduce the chance for accidental contact between a power rail 238 and other components of the PDA 100 (including adjacent power rails 238), as well as reducing the possibility of damage to the power rails 238 or other components.

Each power rail 238 has a protrusion (not shown) that extends into a particular receptacle (not shown) of each power outlet 128 in an outlet gang 130. Each receptacle may receive a prong (not shown) from a power plug (not shown) of an electronic device (not shown). The power rails 238 therefore serve to electrically couple each power outlet 128 in an outlet gang 130. Each power rail 238 corresponds to a particular electrical component, such as a line, neutral, or ground connection of AC line power. The power rails 238 are preferably made from a conducting material, such as a conductive metal.

The use of the power rails 238 obviates individually wiring together multiple individual power outlets 128. Although the power rails 238 are shown as parallel, linear rails, other configurations could be used. For example, the power rails 238 could be curved in order to accommodate an arcuate pattern of power outlets 128.

Each power rail 238 has a connecting prong 244. Although the power rails 238 are shown as only having connecting prongs 244 at one end of each power rail 238, in at least certain embodiments, the connecting prongs 244 are located at both longitudinal ends of each power rail 238.

Each connecting prong 244 is used to place a power rail 238, and therefore a corresponding outlet gang 130, in electrical communication with other electrical components. The connecting prong 244 may be coupled to other electrical components by any suitable connecting means. In some embodiments, wires may be used as the connecting means. Of course, the present invention is not limited to power rails 238 having connecting prongs 244. Any suitable means may be used for placing the power rails 238 in electrical communication with other electrical components.

With reference now to FIG. 7, each outlet gang 130 (two of which are shown in see-through, environmental lines, in FIG. 7), is shown covered by a layer of nonconductive material 252 that extends substantially across the width of the upper U-shaped portion 206. More than one piece of the nonconductive material 252 may be used and the nonconductive material 252 may be shaped and sized as desired to insulate the electrical components of the PDA 100. The nonconductive material 252 may be made of any suitable material that substantially does not conduct electricity, such as plastics, rubber, and the like. In at least one embodiment, the nonconductive material 252 is Mylar.

The nonconductive material 252 can be used to prevent unintended electrical communication between adjacent electrical components, such as between the outlet gangs 130 and the fuse assemblies 144 (FIG. 1). For example, the nonconductive material 252 may be placed over the back of the outlet gangs 130 and between the fuse assemblies 144 (FIG. 1). The nonconductive material 252 may have holes 256 to allow the connecting prongs 244 to pass therethrough.

In a further embodiment, the PDA 100 includes a circuit link interconnection board 264 that is connected to at least one electrical component. As shown in FIG. 6, the circuit link interconnection board 264 is connected to two outlet gangs 130. However, the circuit link interconnection board 264 can be connected to more or less electrical components of various types. In one embodiment, the circuit link interconnection board 264 is an at least semi-rigid component capable of connecting to, and being in electrical communication with, at least one electrical component. In a presently preferred embodiment, the circuit link interconnection board 164 is capable of placing a plurality of electrical components in electrical communication. In certain embodiments, the circuit link interconnection board 264 is a printed circuit board. In at least one embodiment, the circuit link interconnection board 264 is a four-layer printed circuit board.

The circuit link connector 264 may have a number of holes (or pads) 268 extending therethrough. The holes 268 may be lined with a conducting material, such as a conductive metal. In at least one embodiment, a connecting prong 244 of a power rail 238 associated with an outlet gang 130 engages a hole 268. If desired, the connecting prong 244 may be further secured to the circuit link interconnection board 264, such as by soldering. Nonconductive material 252 may be placed between the connecting prongs 244 and the circuit link interconnection board 264. The connecting prongs 244 may extend through openings 256 in the nonconductive material 252.

The circuit link interconnection board 264 is coupled to the upper U-shaped portion 206 of the housing 104. In one embodiment, the circuit link interconnection board 264 is provided with a fastener hole 270. A fastener 272, such as a screw, is inserted through the fastener hole 270 and securely received by a mount 322 (FIG. 5) on the upper U-shaped portion 206. The fastener 272 may serve as a ground connection for a circuit of the PDA 100 (FIG. 1).

The fuse clamp arms 148 (FIG. 1) are mounted to the outwardly facing side of the circuit link interconnection board 264. The fuse clamps arms 148 are secured by a rivet 276 and by soldered connections 278 to the circuit link interconnection board 264. The circuit link interconnection board 264 has slip-on connectors 282 to which power inputs 284 are attached. Power may thus pass from the power inputs 284, through the slip-on connectors 282, and into the circuit link interconnection board 264 where it can be transferred through the clamp arms 148 and through the holes 268 to the power rails 238 of the outlet gangs 130.

The circuit link interconnection board 264 may be used to transmit electrical signals to, or electrically couple, electrical parts attached to the circuit link interconnection board 264. In at least one embodiment, the circuit link interconnection board 264 is used to transmit components of AC line power to electrical parts attached to opposite ends of the circuit link interconnection board 264. In the case of outlet gangs 130 having connecting prongs 244 at only one end, similar connections between outlet gangs 130 and the circuit link interconnection board 264 may occur at opposite sides of opposite ends of the circuit link interconnection board 264, such as between position 286 and position 288. However, if the outlet gangs 130 are provided with connectors 244 at each end, similar connections between the outlet gangs 130 and the circuit link interconnection board 264 may occur at the same side at each opposite end of the circuit link interconnection board 264, such as between position 286 and position 290. The fastener 272 may serve as a ground connection for the circuit link interconnection board 264 and electrical components attached thereto, thus eliminating the need to provide a separate ground connection.

As shown in FIG. 7, a plurality of wires 292 connect the various components of the PDA 100, such as the outlet gangs 130 and the circuit link interconnection board 264. The wires 292 may be insulated wires, in order to help prevent unintended electrical contact between the wires 292 and the other components of the PDA 100. In addition, the wires 292 may be placed on the opposite side of the nonconductive material 252 from the outlet gangs 130 in order to help prevent such unintended contact. The wires 292 may be secured together by fasteners (not shown), such as locking plastic bands.

In embodiments where the circuit link interconnection board 264 is a printed circuit board having multiple layers, each layer may correspond to a single electrical component. For example, when the circuit link interconnection board 264 is used for power transmission, such as AC line power transmission, one layer may correspond to a line, or "hot", electrical connection, one layer may correspond to a neutral connection, and one layer may be connected to a ground. The use of an entire layer of the circuit link interconnection board 264 for each connection may allow for larger amounts of electricity to flow through the printed circuit board 264.

Figure 8:
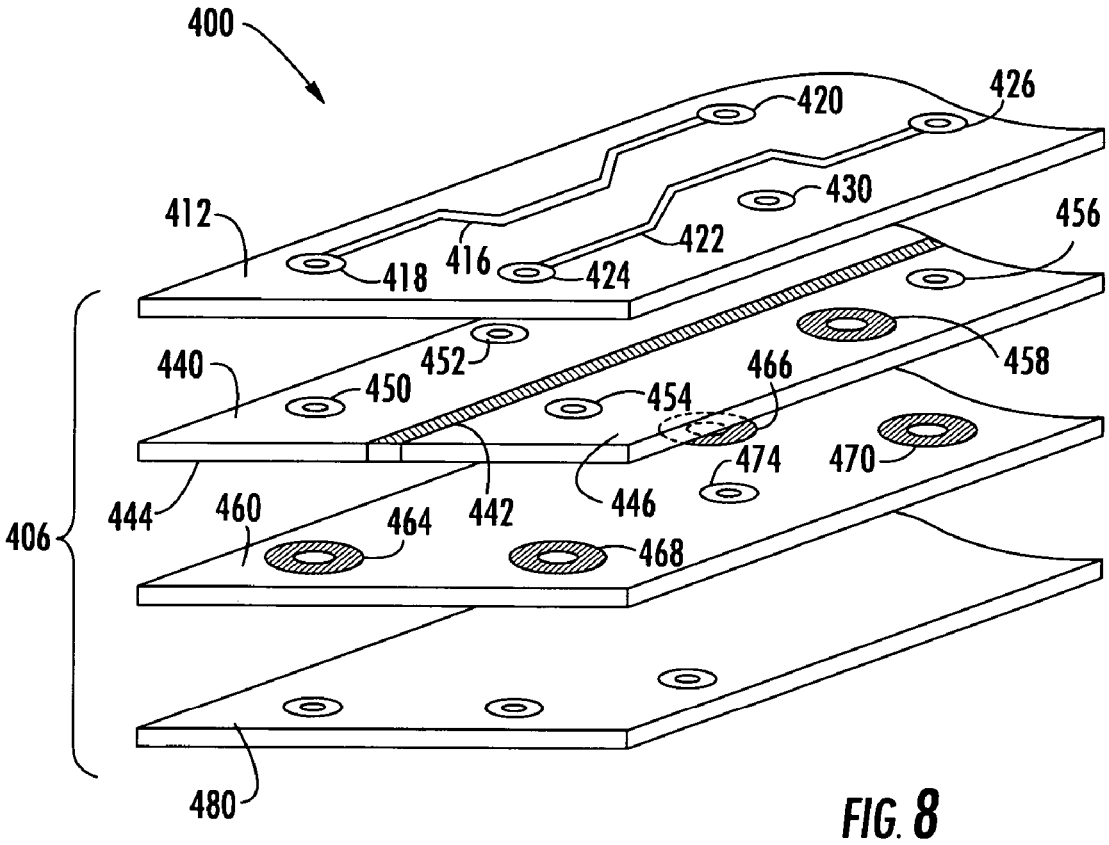
FIG. 8 is an illustration of an embodiment of a circuit link interconnection board formed from a printed circuit board having a plurality of layers and having a layer formed into two sublayers, the two sublayers being insulated from each other.

FIG. 8 depicts an alternate embodiment of a circuit board 400 for use in embodiments of the present invention, including as part of a circuit link interconnection board 264. The circuit board 400 comprises a plurality of layers 406. Each layer 406 may be used to transmit one or more electrical components, such as components of AC line power.

Layer 412 may be a signal layer having a connection 416 between a first connection point 418 and a second connection point 420. The layer 412 may also have a connection 422 between a third connection point 424 and a fourth connection point 426. Connections 416 and 422 serve to transmit electrical signals to, or electrically couple, devices or components attached to connection points 418, 420 and 424, 426, respectively. Additional connection points, such as connection point 430 may also be provided. Although FIG. 8 depicts connections between connection points on the same side of the circuit board 400, connections can be made between connection points at any location of the circuit board 400. For example, a connection could be made between the connection point 418 and the connection point 426.

Layer 440 is shown as a split plane. The layer 440 may be substantially a solid plane of conducting material, such as copper. However, the layer 440 has an insulating barrier 442 which divides the layer 440 into a first side 444 and a second side 446. The insulating barrier 442 may be an area of the layer 440 where the conducting material has been removed, an insulating material or coating placed on or in the layer 440, or any other suitable insulating means. The layer 440 also has connection points 450, 452 and 454, 456 which may be in communication with connection points 418, 420 and 424, 426, respectively.

Each side 444, 446 of the circuit board 400 may carry an electronic component, such as a component of AC line power, which may be the same or different. In at least one embodiment, the first side 444 carries a line component of AC line power and the second side 446 carries a neutral component of AC line power. In this way, power can be conducted through the layer 440 to devices attached to the connection points 418–426. A connector 458 is shown having at least a portion of its conducting material removed, or otherwise being insulated from the connection point 430.

As shown in FIG. 8, layer 460 may be a unified conductive layer, such as a copper layer. However, connectors 464, 466, 468, 470, located on layer 460, have had at least a portion of their conducting material removed, or otherwise are insulated from connection points 418–426 and 450–456. Connection point 474 is in communication with the connection point 430. Layer 480 may be another signal layer.

The use of split plane layers may allow for a greater variety of electrical signals and power components to be distributed across the circuit board 400, while allowing circuit boards having a relatively small number of layers to be used. In addition, circuit boards having split plane layers may allow a greater number of connections to be made, a greater variety of connections to be made, and/or a greater number of devices to be connected by, or to, a circuit board 400.

Embodiments of the circuit board 400 are not limited to the circuit board 400 shown in FIG. 8. For example, greater or fewer layers could be used, the number and position of signal, solid, and split layers may be varied. In addition, transmission layers may be broken up into more than two sublayers. However, each sublayer is preferably suitably large enough to transmit the desired electrical component. In the case of power transmission, particularly AC power transmission, even more particularly AC-line power, each layer or sublayer is preferably suitably large enough to effectively transmit a component of AC line power.

It can thus be seen that certain embodiments of the present invention provide a PDU having substantially reduced wiring requirements, which may result in faster assembly, more economical construction, smaller size, greater reliability, and easier, safer maintenance or repair of the PDU. Further embodiments provide a PDU having fuses (or other circuit links) which are accessible from the exterior of the PDU without disassembling the PDU or removing the PDU from a rack. Yet further embodiments provide a circuit link interconnection board configured to deliver power to at least one electrical component and to place the at least one electrical component in communication with a circuit link, such as a fuse.

Certain embodiments provide a visual cue on a device containing one or more circuit link that one or more the device's circuit links needs to be reset or replaced. These embodiments may allow an operator to more easily locate such circuit links, among other circuit links on the device and other nearby circuit link containing devices, which may reduce equipment downtime and/or service costs.

At least certain embodiments provide for devices with branched circuit protection, where one or more outlets are protected by a circuit link, and each device typically has a plurality of branches. Reducing the number of outlets protected by each circuit link may limit the scope of any disruption caused by a failed circuit link.

Although generally described as including multiple outlets, a branch may contain a single outlet. The number of outlets protected by a circuit link can be varied as desired, including based on the operating conditions and/or the space available in devices that will contain the circuit links.

It is to be understood that the above discussion provides a detailed description of preferred embodiments. The embodiments are illustrative and not intended to limit the scope of the present invention. The above descriptions of the preferred embodiments will enable those skilled in the art to make many departures from the particular examples described above to provide apparatus constructed in accordance with the present invention. The scope of the present invention is rather to be determined by the scope of the claims as issued.

What is claimed is:

1. A power distribution unit comprising in combination:

(A) a power distribution unit housing having at least one power input passage and a plurality of outlet gang apertures penetrating the power distribution unit housing;

(B) a power input penetrating the power distribution unit housing through the at least one power input passage in the power distribution unit housing;

(C) a first power outlet gang comprising a first plurality of power outlets and having a first outlet gang periphery surrounding the first plurality of power outlets, the first power outlet gang being (i) mounted within the power distribution unit housing with the first power outlet gang periphery penetrating, and surrounded by, a first outlet gang aperture among the plurality of outlet gang apertures, and (ii) in power supply communication with the power input and connectable to a plurality of separate electronic apparatus;

(D) a second power outlet gang separate from the first power outlet gang, the second outlet gang comprising a second plurality of power outlets and having a second outlet gang periphery surrounding the second plurality of power outlets, the second power outlet gang being (i) mounted within the power distribution unit housing with the second outlet gang periphery penetrating, and surrounded by, a second gang outlet gang aperture among the plurality of outlet gang apertures, and (ii) in power supply communication with the power input and connectable to a plurality of separate electronic apparatus; and (E) a circuit link connector directly linking the first power outlet gang and the second power outlet gang, the circuit link connector being in power supply communication with the power input and comprising:

(a) a printed circuit board having a plurality of connection points; and (b) first and second circuit link terminals coupled to the printed circuit board, said first power outlet gang being electrically connected to one or more of the plurality of connection points and in power supply communication with the first circuit link terminal through the printed circuit board, and said second power outlet gang being electrically connected to one or more of the plurality of connection points and in power supply communication with the second circuit link terminal through the printed circuit board.

2. The power distribution unit of claim 1 wherein each of the first and second outlet gangs comprises:

(C) at least one circuit rail;

(D) a plurality of power outlets coupled to the at least one circuit rail; and (E) a power outlet contact in power supply communication with the at least one circuit rail.

3. The power distribution unit of claim 1 wherein the circuit link connector further comprises at least one circuit link status indicator, whereby each circuit link status indicator indicates the status of a respective circuit link placed in at least one of the first and second fuse holders.

4. The power distribution unit of claim 3 wherein each of the at least one circuit link status indicator further comprises an illuminable indicator.

5. The power distribution unit of claim 4 wherein the illuminable indicator is in electrical communication with the power input through the respective circuit link connector.

6. The power distribution unit of claim 1 wherein the first outlet gang comprises at least four pre-joined power outlets.

7. The power distribution unit of claim 6 wherein each of the first and second outlet gangs comprises:

(A) at least one circuit rail;

(B) a plurality of power outlets coupled to the at least one circuit rail; and (C) a power outlet contact in power supply communication with the at least one circuit rail.

8. The power distribution unit of claim 6 wherein the second outlet gang comprises at least four pre-joined power outlets.

9. The power distribution unit of claim 8 wherein each of the first and second outlet gangs comprises:

(A) at least one circuit rail;

(B) a plurality of power outlets coupled to the at least one circuit rail; and (C) a power outlet contact in power supply communication with the at least one circuit rail.

10. A breakable circuit link connector of the type usable to distribute power to one or more electrical components, the breakable circuit link connector comprising:

(A) a printed circuit board comprising a plurality of layers with at least a first layer comprising at least a first AC power component line and a second layer comprising at least a second AC power component line;

(B) a board power supply connector coupled to the printed circuit board and couplable to a mating AC power transmission connector;

(C) at least one breakable circuit link coupled to the printed circuit board in power receiving communication with the board power supply connector and in power supply communication with at least the first or second AC power component line; and (D) plurality of electrical component connectors on the printed circuit board, each electrical component connector being in power supply communication with at least one among the first AC power component line and the second AC power component line and being connectable in power supply communication with at least one mating connector on one among a plurality of power outlet gangs;

wherein the printed circuit board can be positioned intermediate and directly connected to a first power outlet gang and a second power outlet gang among the plurality of power outlet gangs with each power outlet gang comprising a plurality of interconnected power outlets, and wherein (i) the first and second power outlet gangs are spaced apart from each other, and (ii) the at least one breakable circuit link comprises a first breakable circuit link and a second breakable circuit link with the first outlet gang being electrically couplable to the first breakable circuit link and the second outlet gang being electrically couplable to the second breakable circuit link.

11. The breakable circuit link connector of claim 10, further comprising a fastener opening formed in the printed circuit board, the fastener opening being in electrical communication with the circuit of the printed circuit board, wherein a fastener may be inserted through the fastener opening and thereby serve as a ground connection for the circuit.

12. The breakable circuit link connector of claim 10 wherein the first circuit link comprises a circuit breaker.

13. The breakable circuit link connector of claim 10 wherein the breakable circuit link comprises a fuse holder configured to receive a fuse.

14. The breakable circuit link connector of claim 10 wherein the power supply connector comprises a quick connect tab.

15. The breakable circuit link connector of claim 10 wherein each electrical component connector comprises a pad on the printed circuit board.

16. The breakable circuit link connector of claim 10 wherein at least one of the plurality of layers has a plurality of sublayers, with each sublayer configured to transmit a component of AC line power.

17. The breakable circuit link connector of claim 10 wherein the printed circuit board comprises two power supply circuits with each power supply circuit being in power supply communication with at least one respective electrical component connector and with said at least one respective electrical component connector being connectable in power supply communication with a respective power outlet gang.

18. The breakable circuit link connector of claim 10, further comprising a circuit link indicator coupled to the printed circuit board and in communication with the breakable circuit link.

19. The breakable circuit link connector of claim 18 wherein the circuit link indicator comprises a light emitting diode.

20. The breakable circuit link connector of claim 10 wherein the first outlet gang comprises at least four pre-joined power outlets.

21. The breakable circuit link connector of claim 20 wherein the second outlet gang comprises at least four pre-joined power outlets.

22. A method of making a power distribution unit, the method comprising:

(A) with a first power outlet gang comprising a first plurality of power outlets surrounded by a first power outlet gang periphery, mounting the first power outlet gang periphery of the first power outlet gang within a matingly surrounding first power outlet gang aperture in a power distribution unit housing and orienting a first power outlet gang electrical power supply terminal in the interior of the power distribution unit housing;

(B) with a second power outlet gang comprising a second plurality of power outlets surrounded by a second power outlet gang periphery, mounting a the second power outlet gang periphery of the second power outlet gang within a matingly surrounding second power outlet gang aperture in the power distribution unit housing and orienting a second power outlet gang electrical power supply terminal in the interior of the power distribution unit housing;

(C) providing an electrical power supply interconnection board within the interior of the power distribution unit housing and connecting the electrical power supply interconnection board to the first power outlet gang electrical power supply terminal and to the second power outlet gang electrical power supply terminal; and (D) providing a first circuit link element in electrical communication with the first power outlet gang electrical power supply terminal and a second circuit link element in electrical communication with the second outlet gang electrical power supply terminal.

23. The method of claim 22 wherein the electrical power supply interconnection board comprises a printed circuit board having a plurality of layers, and wherein connecting the electrical power supply interconnection board to the at least first power outlet gang electrical supply terminal and to the second power outlet gang electrical supply terminal comprises connecting the at least first power outlet gang electrical supply terminal to one of the plurality of layers and connecting the at least second power outlet gang electrical supply terminal to the one or another of the plurality of layers.

24. The method of claim 22, further comprising mounting a first illuminable circuit link element status indicator in the power distribution unit housing and connecting the first illuminable circuit link element status indicator to the first circuit link element, and mounting a second illuminable circuit link element status indicator in the power distribution unit housing and connecting the second illuminable circuit link element status indicator to the second circuit link element.

25. The method of claim 22 wherein the first power outlet gang comprises at least four pre-joined power outlets.

26. The method of claim 25 wherein the second power outlet gang comprises at least four pre-joined power outlets.

* * * * *